US006616376B1

(12) United States Patent
Fuerle

(10) Patent No.: US 6,616,376 B1
(45) Date of Patent: Sep. 9, 2003

(54) BAGGING ICEBERGS

(76) Inventor: Richard D. Fuerle, 1711 W. River Rd., Grand Island, NY (US) 14072

( * ) Notice: Subject to any disclaimer, the term of this patent is extended or adjusted under 35 U.S.C. 154(b) by 0 days.

(21) Appl. No.: 10/065,153

(22) Filed: Sep. 22, 2002

(51) Int. Cl.[7] ..... E02B 15/02
(52) U.S. Cl. ..... 405/61; 405/63; 405/64
(58) Field of Search ..... 405/60, 61, 63, 405/64, 65, 67, 211, 217

(56) References Cited

U.S. PATENT DOCUMENTS

| | | | | |
|---|---|---|---|---|
| 3,289,415 A | * | 12/1966 | Merrill | 405/61 |
| 4,258,640 A | * | 3/1981 | Mougin | 405/61 |
| 4,289,423 A | * | 9/1981 | Mougin | 405/61 |
| 4,299,184 A | * | 11/1981 | Mougin | 114/253 |
| 4,854,780 A | * | 8/1989 | Hewlings | 405/211 |

FOREIGN PATENT DOCUMENTS

| | | |
|---|---|---|
| DE | 3217560 | * 11/1983 |
| DE | 3315744 | * 10/1984 |
| DE | 3412707 | * 10/1985 |
| WO | 85/05609 | * 12/1985 |

OTHER PUBLICATIONS

Victor, Paul–Emile, "Will deserts dring icebergs? tapping Antartica's freshwater reserves," May. 1986, pp. 53–54.*
Siegle, Lucy, "Life: Innovations 100: Environment: How the . . . ," Mar. 2002, p. 3.*
Fannin, Penny, "How do you drink an iceberg?," Nov. 2001, pp. 12–13.*

* cited by examiner

*Primary Examiner*—Heather Shackelford
*Assistant Examiner*—Frederick L. Lagman
(74) *Attorney, Agent, or Firm*—Richard D. Fuerle

(57) ABSTRACT

A flexible, waterproof bag is used to contain a iceberg. The bag has an opening that can be closed and an edge around the opening. At least one float is attached to the edge of the bag and a drain is located away from the edge. One end of a conduit is attached to the drain and the other end of the conduit is attached to a buoy. A portion of the edge is sunk with a weight and is pulled under the iceberg. The sunken portion is re-floated by releasing the weight, which results in the edge surrounding the iceberg. The opening of the bag is closed over the iceberg.

20 Claims, 7 Drawing Sheets

BAGGING ICEBERGS

BACKGROUND OF INVENTION

This invention relates to a method and apparatus for bagging an iceberg. In particular, it relates to a sealable bag having a drain and to a method of putting an iceberg inside the bag.

In some areas of the world, especially those with warm, dry climates, such as the Middle East and Southern California, there is a lack of fresh water. The Middle East is largely desert and rainfall is minimal. There is little river water available and desalination of seawater is quite expensive. In Southern California, the large and growing population requires more water than is available from rivers and wells.

Global warming has resulted in more ice breaking off the polar icecaps, forming icebergs. These icebergs consist of fresh water deposited many years ago as snow. When the icebergs melt not only is this fresh water lost, but it may disrupt the Gulf Stream, preventing warm water from the Caribbean from moving north. That, in turn, could produce another ice age in Europe and North America.

SUMMARY OF INVENTION

In this invention, one edge of a large, flexible, waterproof bag with floats at the open end and a drain at the bottom is sunk and drawn under an iceberg by a ship. When that edge is re-floated, the iceberg is inside the bag. The edges of the bag are tied over the iceberg and salt water is pumped out of the bag from the drain. As the iceberg melts, the bag fills with fresh water and can be pulled by the ship to where the freshwater is needed. The water can then be pumped out of the bag through the drain.

In preferred embodiments, once the edge is re-floated around the iceberg, air is pumped into the bag through the drain causing the iceberg to sink, or saltwater is removed from the bag through the drain, so that it is easier to seal the bag.

DETAILED DESCRIPTION

Figure 1:
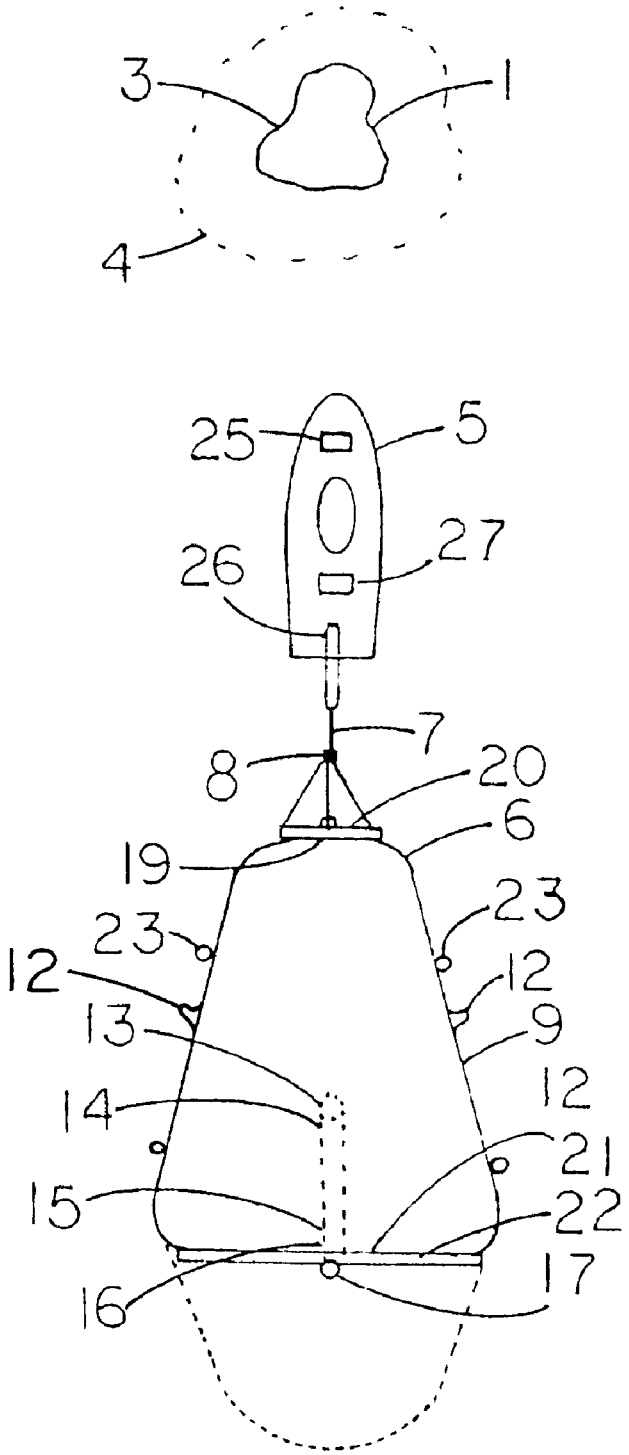
FIG. 1 is a plan view showing a ship approaching an iceberg pulling a bag according to this invention.
Figure 2:
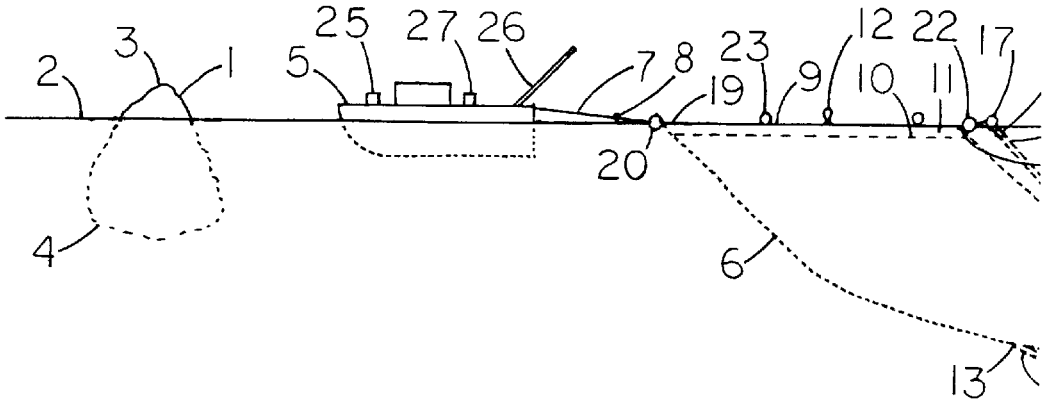
FIG. 2 is a front view of the view shown in FIG. 1.

In the drawings, an iceberg 1 floating in water 2 (typically saltwater) has a small portion 3 above water and a larger portion 4 below water. Referring particularly to FIGS. 1 and 2, ship 5 pulls bag 6 towards iceberg 1 by means of tow line 7. At the end of tow line 7 is a clamp 8 that can be remotely opened from ship 5, for example, by a cable or by radio control. Bag 6 is made of a flexible, waterproof material, such as heavy plastic, rubberized canvas, etc. and is large enough to completely contain iceberg 1. Preferably, edge 9 of bag 6 is overlapped at 10 so that it has channel 11 therethrough with a drawstring 12 within channel 11. Channel 11 is open at a few locations, where drawstring 12 is exposed and can be withdrawn. Bag 6 is also provided with a drain 13 at or near an area of bag 6 farthest from or opposing edge 9. The weight of drain 13 keeps drain 13 at the lowest point of bag 6. To drain 13 is attached one end 14 of a conduit 15, the other end 16 of which is held by buoy 17. Conduit 15 can be opened or closed by valve 18 located at or near end 16; valve 18 is initially open. Alternatively, instead of using buoy 17, end 16 can be attached to ship 5.

One side 19 of edge 9 is attached to short elongated float 20 and the other opposite side 21 of edge 9 is attached to long elongated float 22. Floats 20 and 22 are preferably rigid, but could resiliently bend under stress. Short float 20 (shown with straps) helps to distribute the stress on the edge of the bag as it is being towed. Short float 20 can be made rigid in the center with resilient ends for that purpose. Long float 22 is preferably longer than the width of iceberg 1 so that bag 6 avoids contacting iceberg 1 as much as possible. Additional small floats 23 are attached to edge 9 at other locations. Floats 20, 22, and 23 can be permanently attached to edge 9 but are preferably removeable. A single float could also be attached around the entire edge 9. Clamp 8 can be attached directly to edge 9 of bag 8, but it is preferably attached to float 20, as shown in the drawings, to distribute the stress of towing.

Figure 3:
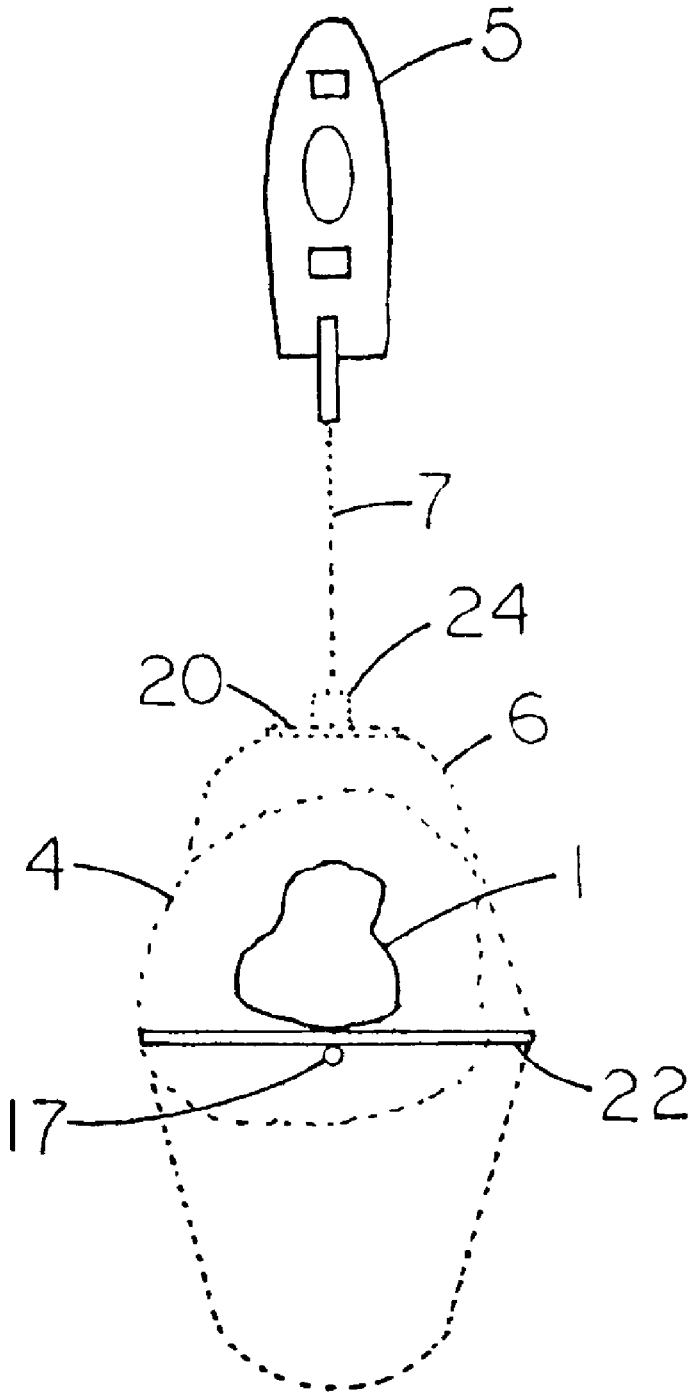
FIG. 3 is a plan view showing a ship, a bag, and an iceberg, where the portion of the bag closest to the iceberg has been sunk and the ship has moved around to the opposite side of the iceberg.
Figure 4:
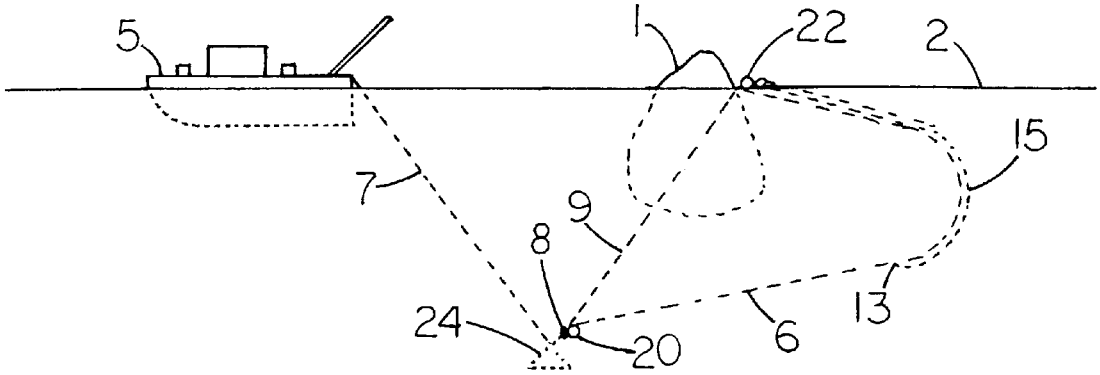
FIG. 4 is a front view of the view shown in FIG. 3.
Figure 5:
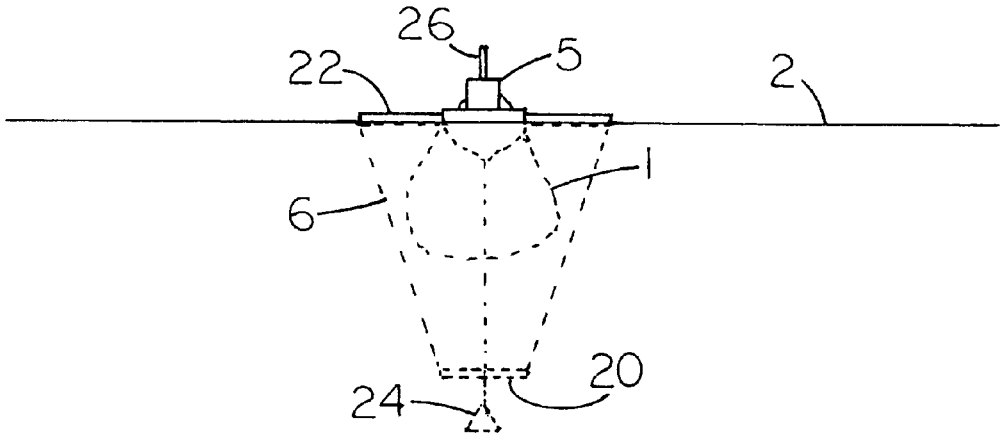
FIG. 5 is side view of the view shown in FIG. 3.

Referring particularly to FIGS. 3, 4, and 5, as ship 5 nears iceberg 1 it stops and attaches weight 24 to the end of tow line 7. Weight 24 is heavy enough to sink short float 20, attached edge 19, and that portion of edge 9 that is in between short float 20 and long float 22, but weight 24 is not heavy enough to also sink long float 22. Allowing some slack in tow line 7, ship 5 maneuvers to the opposite side of iceberg 1, then begins pulling in tow line 7 so that ship 5, bag 6, and iceberg 1 are positioned as shown in FIGS. 3, 4, and 5, with long float 22 bumping against iceberg 1. After short float 20 has passed under iceberg 1, ship 5 remotely opens clamp 8, releasing tow line 7 with weight 24 attached, and winds in tow line 7. Short float 20 and small floats 23 cause edge 9 of bag 6 to rise to the surface, but now iceberg 1 floats inside edge 9 of bag 6. Ship 5 maneuvers around to buoy 17 and retrieves end 16 of conduit 15.

Figure 6:
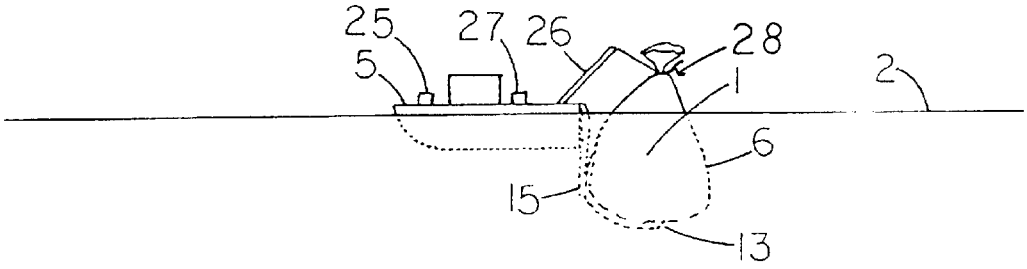
FIG. 6 is a front view showing a ship and a bag tied around an iceberg.
Figure 7:
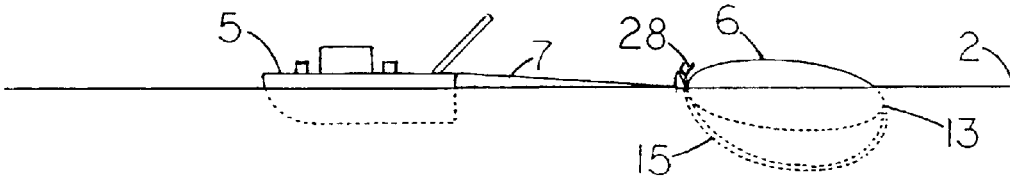
FIG. 7 is a front view showing a ship pulling a bag of melted iceberg water.

End 16 of conduit 15 is attached to air pump 25 on ship 5, valve 18 is opened, and air is pumped into the bottom of bag 6. The air lowers the density of the seawater within bag 6 until it is about the same as the density of iceberg 1, causing iceberg 1 to almost completely sink. In this position, drawstring 12 can be pulled tight and tied, sealing bag 6, as shown in FIG. 6. Air flow can be stopped and floats 20, 22, and 23 can be removed from edge 9. Alternatively, edge 9 can be lifted over the top of iceberg 1 by hooking drawstring 12 where it is exposed with a line from crane 26 on ship 5. To avoid lifting seawater in bag 6, valve 18 is opened. Preferably, end 16 of conduit 15 is attached to water pump 27 on ship 5 and seawater is pumped out of bag 6. This enables bag 6 to be easily raised around iceberg 1 as it shrinks around iceberg 1. Instead of using drawstring 12, bag 6 can also be sealed by other means, such as by using a zipper-type lock on edge 9 instead of drawstring 12. Cord 28 can be tied around the top of bag 6 to further seal the opening in bag 6, as shown in FIG. 6.

Bag 6 can be towed by ship 5 by pulling conduit 15 or cord 28, or by another means, such as a net placed around bag 6. As iceberg 1 melts, seawater within bag 6 is pumped out of bag 6 until the water being pumped out is sufficiently fresh. Valve 18 is then closed. Bag 6 will not sink because the fresh water inside it is not as dense as saltwater. After ship 5 reaches its destination, the melted iceberg water in bag 6 can be pumped out though conduit 15.

What is claimed is:

1. Apparatus for enclosing an iceberg floating in water comprising (A) a flexible, waterproof bag of a size sufficient to contain said iceberg, said bag having an opening that can be closed, an edge around said opening, at least one float attached to said edge, and a drain located from said edge;

(B) a conduit, one end of which is attached to said drain;

(C) a ship having a tow line, one end of which is removably attachable to said edge; and (D) a weight at said one end of said tow line, sufficient to sink a portion of said edge, but not all of said edge.

2. Apparatus according to claim 1 wherein said edge is overlapped to form a channel, including a drawstring within said channel, where said channel is open at locations for access to said drawstring, whereby said opening can be closed by pulling said drawstring.

3. Apparatus according to claim 1 wherein said tow line can be remotely removed from said edge.

4. Apparatus according to claim 1 including a short float and a long float attached to opposing portions of said edge.

5. Apparatus according to claim 1 wherein the other end of said conduit is attached to a buoy.

6. Apparatus according to claim 1 wherein said ship has a crane for lifting said edge above said iceberg.

7. Apparatus according to claim 1 including an air pump on said ship attachable to the other end of said conduit for pumping air into said bag through said conduit.

8. Apparatus according to claim 1 including a water pump on said ship and attachable to the other end of said conduit for pumping water out of said bag through said conduit.

9. Apparatus according to claim 1 including a valve at the other end of said conduit.

10. A method of enclosing an iceberg within a bag using apparatus according to claim 1 comprising (A) attaching said tow line to said bag, whereby a portion, but not all, of said edge sinks;

(B) positioning said ship so that said iceberg is between said ship and said bag;

(C) pulling said tow line with said ship, whereby said sunken portion of said edge passes under said iceberg;

(D) removing said weight from said bag, whereby said sunken portion floats and said edge surrounds said iceberg;

(E) closing said opening with said iceberg within said bag; and (F) removing water from said bag through said conduit.

11. A method according to claim 10 wherein, between steps (D) and (E), said iceberg is partially sunk by pumping air into said bag through said conduit.

12. A method according to claim 10 wherein, between steps (D) and (E), water is pumped out of said bag to facilitate closing said opening.

13. An iceberg enclosed within a bag according to the method of claim 10, wherein said bag has a single drain.

14. Apparatus for enclosing an iceberg floating in saltwater comprising (A) a flexible, waterproof bag large enough to enclose said iceberg having (1) an opening that can be closed;

(2) an edge around said opening;

(3) a drain opposing said edge; and (4) a first elongated float attached to a leading portion of said edge and a second longer elongated float attached to an opposing portion of said edge;

(B) a conduit, one end of which is attached to said drain and the other end of which is attached to a buoy;

(C) a valve at said other end of said conduit;

(D) a ship having a tow line, one end of which is removably attachable to said first elongated float; and (E) a weight at said one end of said tow line, sufficient to sink said first elongated float, but insufficient to sink both said first elongated float and said second elongated float.

15. Apparatus according to claim 14 wherein said ship has a water pump attachable to said conduit.

16. A method of enclosing an iceberg within a bag using apparatus according to claim 14 comprising (A) positioning said bag with said first elongated float adjacent said iceberg;

(B) attaching said tow line to said first elongated float, whereby said leading portion of said edge and said first elongated float sink beneath said iceberg;

(C) maneuvering said ship to the opposite side of said iceberg;

(D) pulling said leading portion of said edge under said iceberg;

(E) removing said tow line from said first elongated float, whereby said leading portion of said edge re-floats and said iceberg floats within said edge;

(F) closing said opening; and (G) removing saltwater from said bag through said conduit.

17. An iceberg enclosed within a bag according to the method of claim 16, wherein said bag has a single drain.

18. Apparatus for enclosing an iceberg floating in seawater comprising (A) a ship having thereon a water pump;

(B) a flexible, waterproof bag of a size sufficient to enclose said iceberg and having (1) an opening that can be closed;

(2) an edge around said opening;

(3) means for closing said opening;

(4) a drain opposite said opening;

(5) a short elongated float attached to a leading portion of said edge; and (6) a long elongated float attached to an opposing portion of said edge;

(C) a remotely-releasable clamp attachable to said short elongated float;

(D) a tow line, a first end of which is attached to said ship and a second end of which is attached to said clamp;

(E) a weight attached to said second end of said tow line, sufficient to sink said short elongated float, but insufficient to sink both said short elongated float and said long elongated float;

(F) a conduit, a first end of which is attached to said drain and a second end of which is attached to said buoy; and (G) a valve within said conduit at said second end.

19. A method of enclosing an iceberg within a bag using apparatus according to claim 18 comprising (A) floating said bag with said short elongated float adjacent to one side of said iceberg;

(B) attaching said clamp to said short elongated float, whereby said short elongated float and said leading portion of said edge sink;

(C) moving said ship to the opposite side of said iceberg;

(D) using said tow line, pulling said leading portion of said edge under said iceberg;

(E) releasing said clamp, whereby said short elongated float rises to the surface and said iceberg floats within said edge;

(F) closing said opening; and (G) pumping seawater out of said bag through said conduit.

20. An iceberg enclosed within a bag according to the method of claim 19, wherein said bag has a single drain and said opening is above the surface of said water.

* * * * *